United States Patent [19]

Lacroix

[11] Patent Number: 4,667,977

[45] Date of Patent: May 26, 1987

[54] METHOD OF MANUFACTURING LAMINATED SKIS WITH BUILT-IN METAL BLADES, AND SKIS THUS OBTAINED

[75] Inventor: Daniel Lacroix, Perrignier, France

[73] Assignee: Skis Lacroix S.A., Perrignier, France

[21] Appl. No.: 581,980

[22] Filed: Feb. 21, 1984

[30] Foreign Application Priority Data

Mar. 4, 1983 [FR] France ..... 83 04261

[51] Int. Cl.[4] ..... A63C 5/075

[52] U.S. Cl. ..... 280/602; 280/610

[58] Field of Search ..... 280/610, 602

[56] References Cited

U.S. PATENT DOCUMENTS

| | | | |
|---|---|---|---|
| 1,993,636 | 3/1935 | Ullevoldsaeter | 280/610 |
| 2,526,137 | 10/1950 | Hunt | 280/610 |
| 3,771,805 | 11/1973 | Ishida | 280/610 |
| 3,801,116 | 4/1974 | Benner | 280/610 |
| 3,933,362 | 1/1976 | Sakuma et al. | 280/610 |
| 4,071,264 | 1/1978 | Legrand et al. | 280/610 |
| 4,383,701 | 5/1983 | Hirnböck et al. | 280/610 |
| 4,409,287 | 10/1983 | Harrison | 280/610 |

FOREIGN PATENT DOCUMENTS

| | | | |
|---|---|---|---|
| 310052 | 9/1973 | Fed. Rep. of Germany | 280/610 |
| 2267129 | 7/1975 | France | 280/610 |
| 2405075 | 6/1979 | France | 280/610 |
| 385692 | 3/1961 | Switzerland | 280/610 |

*Primary Examiner*—John J. Love
*Assistant Examiner*—Eric D. Culbreth
*Attorney, Agent, or Firm*—Robert E. Burns; Emmanuel Lobato; Bruce L. Adams

[57] ABSTRACT

This method of manufacturing laminated skis by the so-called wet process consists in incorporating at least one metal blade or a sheet of high-strength fibers among the strata, the width of the blade or sheet being inferior to that of the ski, and the width of its ends decreases gradually to a point in the transitional area between the heel and body and also in the transitional area between the body and the tip of the ski.

5 Claims, 3 Drawing Figures

METHOD OF MANUFACTURING LAMINATED SKIS WITH BUILT-IN METAL BLADES, AND SKIS THUS OBTAINED

BACKGROUND OF THE INVENTION

The present invention relates to a method of manufacturing laminated skis in which metal blades or sheets consisting of high-strength fibres are embedded when the various component elements of the ski are stacked in a mold so as to be welded to one another by means of a suitable resin during the passage of the mold through a heating press causing the resin to polymerize.

THE PRIOR ART

This method currently referred to as the wet-process lamination owing to the interposition between the strata of glass fibre fabric sheets impregnated to excess with a resin which, when caused to diffuse therethrough by melting, imparts the necessary ski strength, is disclosed notably in the French Pat. No. 7412477.

SUMMARY OF THE INVENTION

It is the primary object of the present invention to provide a method of manufacturing skis of the type broadly set forth hereinabove which is capable of imparting a certain remanent resiliency to the ski portions constituting an intermediate area between the main body and the tip on the one hand, and between the main body and the heel on the other hand.

For this purpose the method of this invention is characterized by the fact that among the strata at least one metal blade or a sheet consisting of high-strength fibres is disposed between the sole and the top of the ski, in order to impart a certain remanent resiliency differring from that of the ski body to the intermediate areas extending between the ski body and the tip on the one hand and between the ski body and the heel on the other hand.

The metal blade or sheet of high-strength fibres is somewhat narrower than the ski body or main portion, and its width decreases at its ends to a point at both tip and heel ends, so that the mechanical properties imparted by this embedded blade or sheet to the various ski portions bring more rigidity to the ski body than to the tip and heel sections, the gradual reduction of the width of said blade or sheet being attended by a progressive variation of said properties in the intermediate or transitional areas thus created between the ski body on the one hand, the heel and tip on the other hand.

In a modified form of embodiment of the present invention the ski manufactured according to this method comprises at least two metal blades or two sheets of high-strength fibres which, according to the specific applications contemplated, have the same or different shapes and dimensions.

In order to compensate the thickness of said blades or sheets in the lamination, an impression is formed in the core, the difference in width existing between the sheet and the core permitting a direct contact between the glass fibre fabric soaked to excess with wet resin and the core throughout the outer periphery of this core.

In the ski sections, notably the heel and tip, containing separate metal cores having a limited area with respect to said blades or sheets, fragments of elastomer sheets coated on both faces with wet resin are disposed for the dual purpose of compensating the differences in level between the strata on the one hand, and improving the insertion of said metal element between the resin-impregnated glass fiber fabric elements separating throughout their surface area the various ski-forming strata, on the other hand.

The essential features deriving from this method of manufacturing laminated skis lie in the specific structure affording the adaptation of the skis, to the various snow surface conditions likely to be encountered when skiing, such as rammed, frozen or powdery snow.

Other features and advantages of the invention will appear as the following description proceeds with reference to the attached drawings.

THE DRAWINGS

DESCRIPTION OF THE PREFERRED EMBODIMENTS

Figure 1:
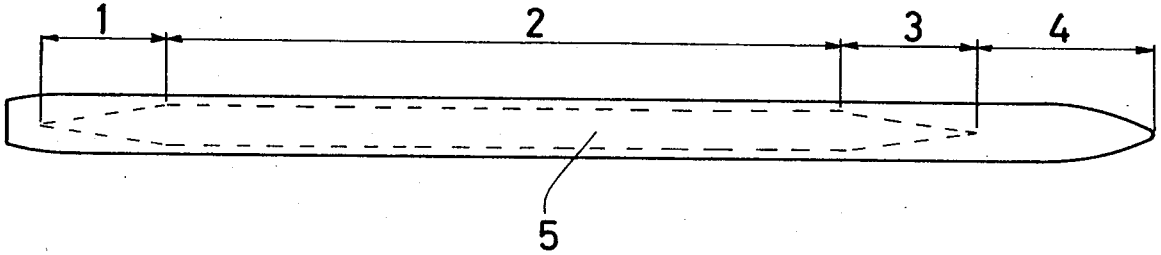
FIG. 1 is a plan view from above of a ski, showing the relative extents of the various sections thereof mentioned in the description.

Firstly, a summary of the various steps of the method of manufacturing a laminated ski is given hereinafter:

In a mold having internal dimensions corresponding to the size and configuration of two identical skis ready for use, and after removing the mold cover, the following component elements are introduced:

the ski sole is disposed in the bottom of the mold impression so as to fill its entire surface area except the lateral edges occupied by the metal edges;

the metal edges;

at least one sheet of glass fibre fabric impregnated in excess with a wet resin;

a metal blade having a width inferior to the ski width so as to fit easily between the metal edges;

sections of elastomer sheets coated with wet resin and adapted to compensate the differences in level in the areas where the metal blade does not cover the sole, namely the transitional areas between the ski body and the tip and heel sections, respectively;

at least one sheet of glass fibre fabric impregnated with wet resin;

a core consisting of three elements, namely two lateral, constant-width battens provided with ski edges of hard plastic material incorporated when molding separately said core, a central beam of a width consistent with the ski shape, said central beam being disposed close to a sheet of glass fibre fabric impregnated with wet resin so as to act as a key and push the lateral battens against the walls of the mold cavity;

the metal heel is disposed between the sheets of elastomer coated with wet resin, at the end of the core and of the metal sheet, without contacting this sheet;

at tip level a metal blade is positioned between elastomer sheets coated with wet resin, at the end of the core and of the metal blade of the body with which said tip metal blade is not in direct contact;

at least one sheet of glass fibre fabric impregnated with wet resin is positioned and covers the entire ski surface from heel to tip, including the tip;

a second metal blade of a width inferior to that of the ski is positioned on top of the core covered with glass fibre fabric so that its ends will not protrude beyond the core limits, or over the heel or tip;

at least one sheet of glass fibre fabric impregnated with wet resin is so positioned as to cover the entire ski area, notably the core portions not covered by the second metal blade, and a top sheet of abrasion-resistant plastic material comprising, on its core-contacting face, an impression having the shape and dimensions of the second metal blade on which this top sheet is disposed so that this impression will compensate the difference in level due to the second metal sheet which is thus embedded in the top sheet of which the edges engage the outer periphery of the core through the medium of said glass fabric.

The cover is subsequently positioned on the mold and the mold is introduced into a suitable heating press in which, under adequate pressure and temperature conditions, the resin will polymerize in order to impart their final cohesion to the skis.

In a modified form of embodiment, the ski core comprises at least one impression obtained during the separate molding of the core. The depth of this impression is equal to the thickness of the metal blade embedded therein, its width and configuration corresponding exactly to the width and configuration of said sheet, so that the resin-impregnated glass-fibre fabric covering the core will adhere directly throughout the periphery of the impression, notably to the core edges on either side of the metal blade and, in the intermediate or transitional areas between the ski body and the heel on the one hand, and between the ski body and the tip on the other hand.

Figure 2:
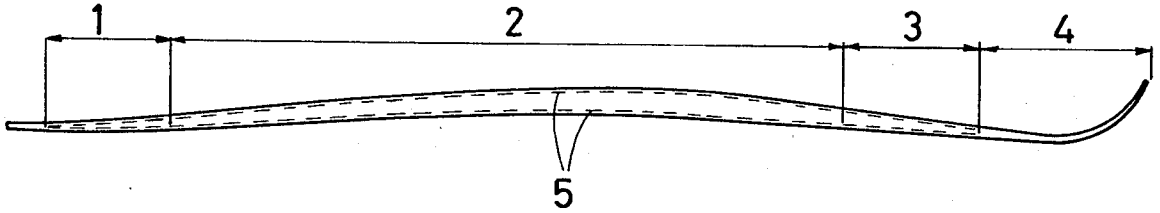
FIG. 2 is a side elevational view of the ski of FIG. 1.

In order to afford a cleared understanding of the following description, the ski illustrated in FIGS. 1 and 2 is divided into four sections as defined hereinafter:

the heel and transitional section 1 between the heel end and the ski body 2;

the ski body 2;

the transitional section 3 between the body 2 and tip 4, and the tip 4.

At least one metal blade 5 or a sheet 5 consisting of high-strength fibres is embedded in the ski structure. This sheet or blade 5 is characterized by two essential features:

its width is inferior to the ski width;

the width of its end sections (1 and 3) decrease gradually to a point in the transitional section 1 between the heel and body 2 and in the other transitional section 3 between the body 2 and the tip 4.

As a result, the ski stiffness is greater in the body section 2 and the ski flexibility increases gradually in the transitional section 1 between the heel and the ski body and also in the transitional area 3 between the body 2 and the tip 4.

Figure 3:
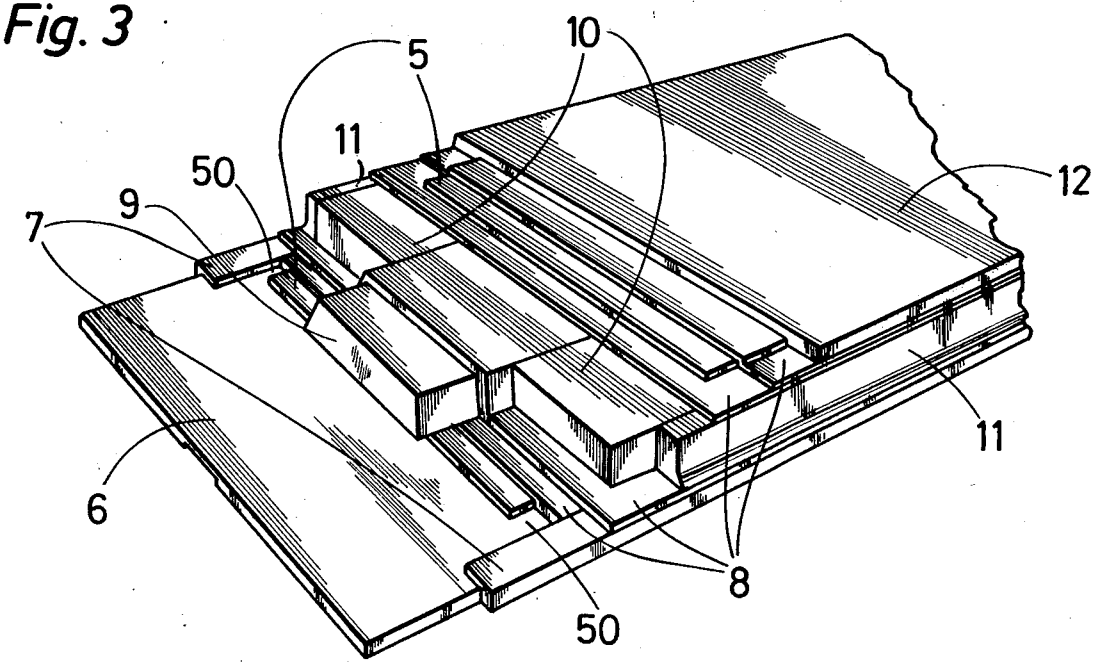
FIG. 3 is a perspective view showing on a larger scale and in cross-section the various component element of a ski constructed according to the teachings of the invention.

FIG. 3 illustrates a typical example of the relative arrangement and disposition of the various strata constituting the ski structure, namely;

a sole 6 lined laterally with metal edges 7;

in direct contact with the sole, a metal blade 5 disposed between the metal edges 7 so as to provide a gap 50 permitting the flow of molten resin between the sheet 5 and the metal edges 7;

a glass fibre fabric sheet 8 impregnated to excess with wet resin;

a core made of three elements, namely a central beam 9 and two lateral battens 10 provided with ski edge molding 11;

a glass fibre fabric sheet 8 impregnated with wet resin and surrounding the central beam 9;

a glass fibre fabric sheet 8 impregnated with wet resin;

a metal blade 5;

a glass fibre fabric sheet 8 impregnated with wet resin, and a ski top 12 of hard plastic material.

Without further analysis, the foregoing will so fully reveal the gist of the present invention that others can by applying current knowledge readily adapt it for the various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A molded ski comprising in cross section;

a sole, metal edges at opposite sides of said sole, said metal edges being of angular cross section with flange portions overlying marginal portions of said sole, a first metal blade in direct contact with said sole, said first metal blade being of a width less than that of said sole and less than the distance between said flange portions of said metal edges to define spaces between lateral edges of said first metal blade and said flange portions of said metal edges, a first glass fiber fabric sheet impregnated to excess with resin overlying said first metal blade and filling said spaces between lateral edges of said first metal blade and said flange portions of said metal edges, a core overlying said first glass fiber fabric sheet and having edge moldings at opposite sides of said core, a second resin impregnated glass fiber fabric sheet overlying said core and edge moldings, a second metal blade of less width than said ski overlying said second glass fiber fabric sheet and, a ski top of hard plastic material overlying said second metal blade and said second glass fiber fabric sheet, said ski top having a plane upper surface and lateral edge portions which are thicker than a central portion and embrace lateral edges of said second metal blade, said metal blades having a length less than that of the ski and having tapered forward and rearward end portions to provide zones of gradual transition between a body portion stiffened by said metal blades, a heel portion without said metal blades and a toe portion without said metal blades, whereby said metal blades impart greater rigidity to said body portion than to said heel and toe portions, the gradual reduction of width of said tapered forward and rearward end portions of said metal blades providing a progressive decrease in rigidity in said zones of gradual transition.

2. A molded ski according to claim 1, in which said core comprises a central beam, two battens at opposite sides of said central beam, and a sheet of resin impregnated galss fibre fabric overlying said central beam, underlying said battens and passing between lateral edges of said central beam and said battens.

3. A molded ski aecording to claim 1, in which forward and rearward ends of said metal blades are spaced apart from one another a distnace less than the spacing of said blades in said body portion.

4. A molded ski comprising a sole, metal edges at opposite sides of said sole, said metal edges being of angular cross section with flange portions overlying marginal portions of said sole, a first metal blade overlying said sole and lying between said flange of said metal edges, said first metal blade being of a width less than the distance between said flange portions of said metal edges to define spaces between lateral edges of said first metal blade and said flange portion of said metal edges, a first glass fibre fabric sheet impregnated to excess with resin overlying said first metal blade and filling said spaces between lateral edges of said first metal blade and said flange portions of said metal edges, a core overlying said first galss fibre fabric sheet, said core comprising a central beam and two battens on opposite sides of said central beam, a second resin impregnated glass fibre fabric sheet having a central portion overlying said central beam, side portions overlying said first flass fibre fabric sheet and said flange portions of said metal edges and underlying said battens and intermediate portions between said central beam and said battens, edge moldings overlying side marginal portions of said second glass fibre fibric sheet and laterally outside said core, a third resin inpregnated glass fibre fabric sheet overlying said core and said edge moldings, a second metal blade overlying said third flass fibre fabric sheet and having a width less than the width of said ski and a ski top of hard plastic material overlying said second metal blade and said third glass fibre fabric sheet, said ski top having a plane upper surface and lateral edge portions which are thicker than a central portion and embrace lateral edges of said second metal blade, said metal blades having a length less than the length of the ski and having tapered forward and rearward end portions to provide zones of gradual transition between a body portion stiffened by said metal blades, a heel portion without said metal blades and a toe portion without said metal blades, whereby said metal blades impart greater rigidity to said body portion than to said heel and toe portions, the gradual reduction of width of said tapered forward and rearward end portions of said metal blades providing a progressive decrease in rigidity in said zones of gradual transition.

5. A molded ski according to claim 4, further comprising a fourth resin impregnated flass fibre sheet having a central portion overlying said second metal blade and marginal side portions offset downwardly from said central portion and bonded to marginal side portions of said third resin impregnated glass fibre fabric sheet.

* * * * *